US005401302A

United States Patent [19]

Schulmerich et al.

[11] Patent Number: 5,401,302

[45] Date of Patent: Mar. 28, 1995

[54] ELECTROSTATIC SEPARATOR COMPRISING HONEYCOMB COLLECTING ELECTRODES

[75] Inventors: Christian Schulmerich, Nidderau; Wilhelm Möller, Neu Isenburg, both of Germany

[73] Assignee: Metallgesellschaft Akitengesellschaft, Frankfurth am Main, Germany

[21] Appl. No.: 193,094

[22] PCT Filed: Apr. 18, 1994

[86] PCT No.: PCT/EP92/02847

§ 371 Date: Feb. 7, 1994

§ 102(e) Date: Feb. 7, 1994

[87] PCT Pub. No.: WO93/11875

PCT Pub. Date: Jun. 24, 1993

[30] Foreign Application Priority Data

Dec. 19, 1991 [DE] Germany ..... 41 41 934.0

[51] Int. Cl.[6] ..... B03C 3/49

[52] U.S. Cl. ..... 96/71; 55/DIG. 38; 95/78; 96/72; 96/100; 138/111; 428/118

[58] Field of Search ..... 96/69–72, 96/98, 100, 52; 95/78, 73; 55/DIG. 38; 428/116–118; 138/111, 112

[56] References Cited

U.S. PATENT DOCUMENTS

| | | | |
|---|---|---|---|
| 3,144,881 | 8/1964 | Sproull | 428/118 X |
| 3,257,779 | 6/1966 | Strubler | 55/DIG. 38 |
| 3,570,218 | 3/1971 | Finney, Jr. | 96/98 X |
| 4,441,897 | 4/1984 | Young et al. | 96/36 |
| 4,550,539 | 11/1985 | Foster | 428/118 X |
| 5,030,254 | 7/1991 | Heyen et al. | 96/100 X |

FOREIGN PATENT DOCUMENTS

| | | | |
|---|---|---|---|
| 940869 | 12/1948 | France . | |
| 392045 | 3/1924 | Germany | 96/98 |
| 2641114 | 5/1981 | Germany . | |
| 3900553 | 12/1989 | Germany | 55/DIG. 38 |
| 1-290420 | 11/1989 | Japan | 428/118 |

*Primary Examiner*—Richard L. Chiesa
*Attorney, Agent, or Firm*—Michael J. Striker

[57] ABSTRACT

An electrostatic separator is described which includes honeycomb collecting electrodes, which consist of star-shaped elements, wherein each star-shaped element consists of three wall parts (1, 2, 3), which are centrally joined and extend at an angle of 120° to each other, at least one tube section (1', 2', 3', 5', 6') extends along the outer edge of each wall part, the tube sections (2', 5', 6') of any two adjacent star-shaped elements are arranged one over the other and adjacent star-shaped elements are connectted by a connecting rod (4), which extends in the tube sections (1', 2', 3', 5', 6') of at least two adjacent star-shaped elements.

2 Claims, 2 Drawing Sheets

ELECTROSTATIC SEPARATOR COMPRISING HONEYCOMB COLLECTING ELECTRODES

TECHNICAL FIELD

This invention relates to an electrostatic separator comprising honeycomb collecting electrodes.

PRIOR ART

Electrostatic separators comprising honeycomb collecting electrodes are known. German Patent Specification 26 41 114 discloses a process of manufacturing a honeycomb electrostatic precipitator of plastic, in which hot-pressed plate strips, which in cross-section have the shape of sheet piling and consist of polyester reinforced by glass fibers, are joined. Each plate strip is provided with flanges, which are joined throughout tile length of the set of honeycombs. The plate strips are either adhesively joined or are joined by welding, if they consist of thermoplastic material.

U.S. Pat. No. 4,441,897 describes an electrostatic precipitator in which the collecting electrodes are also arranged in the form of a honeycomblike grid. In that electrostatic precipitator each collecting electrode is also connected to the adjacent collecting electrode throughout the length of the honeycomb structure.

SUMMARY OF THE INVENTION

It is an object of the invention to provide an electrostatic separator which comprises honeycomb collecting electrodes and in which the several components are joined in a simple manner so that the number of the honeycomb collecting electrodes can be adapted to fluctuating exhaust gas rates or pollutant concentrations relatively quickly and in a simple manner.

The object underlying the invention is accomplished by an electrostatic separator comprising honeycomb collecting electrodes, which consist of star-shaped elements, wherein each star-shaped element consists of three wall parts, which are centrally joined and extend at an angle of 120° to each other, at least one tube section extends along the outer edge of each wall part, the tube sections of any two adjacent star-shaped elements are arranged one over the other and adjacent star-shaped elements are connected by a connecting rod, which extends in the tube sections of at least two adjacent star-shaped elements. The term "tube section " describes a section of a tube which provides a sufficient guidance for the connecting rod and has a length of 5 to 50 cm. The star-shaped elements are made of electrically conductive materials, such as steel or lead. Each tube section is joined, e.g., by welding or adhesive joints, to the outer edges of each wall part. It has surprisingly been found that the electric separator in accordance with the invention can be adapted in a relatively simple manner to fluctuating exhaust gas rates and the collecting surface of the collecting electrodes can be completely utilized because both surfaces of the three centrally joined wall parts of a star-shaped element can be utilized as collecting surfaces. When an increase of the exhaust gas rate, for instance, is to be expected, the grid constituted by the honeycomb collecting electrodes can be increased in size quickly and in a relatively simple manner in that additional star-shaped elements are correspondingly arranged.

In accordance with a preferred feature of the invention the star-shaped elements are made of an electrically conductive plastic. In that case the advantage will be afforded that the star-shaped elements with the tube sections extending along the outer edges of each wall part can be made as individual parts without a need for joining processes, such as welding or adhesive bonding, to join the tube sections to the wall part concerned.

BRIEF DESCRIPTION OF THE DRAWINGS

The invention will now be explained more in detail and by way of example with reference to the drawing (FIGS. 1 to 4).

DETAILED DESCRIPTION OF THE PREFERRED EMBODIMENT

Figure 1:
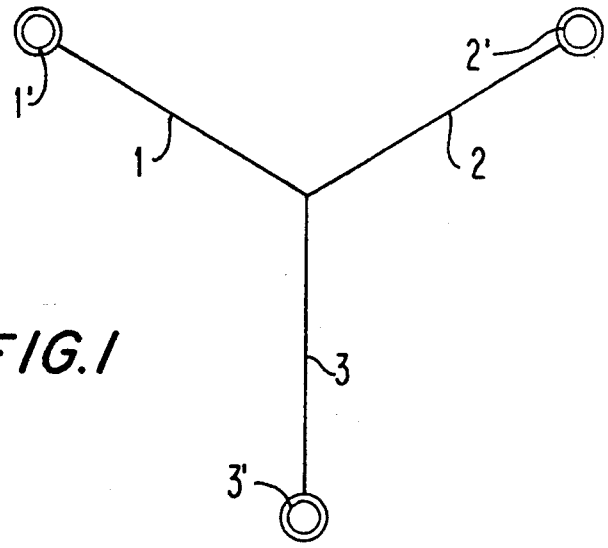
FIG. 1 is a top plan view showing a star-shaped element which consists of three centrally joined wall parts.

FIG. 1 is a top plan view showing a star-shaped element, which consists of three centrally joined wall parts 1,2,3. The angle between any two adjacent wall parts 1 and 2, 2 and 3 or 3 and 1 is 120° . At least one tube section 1', 2', 3' extends along the longitudinal edge of each wall part 1, 2, 3.

Figure 2:
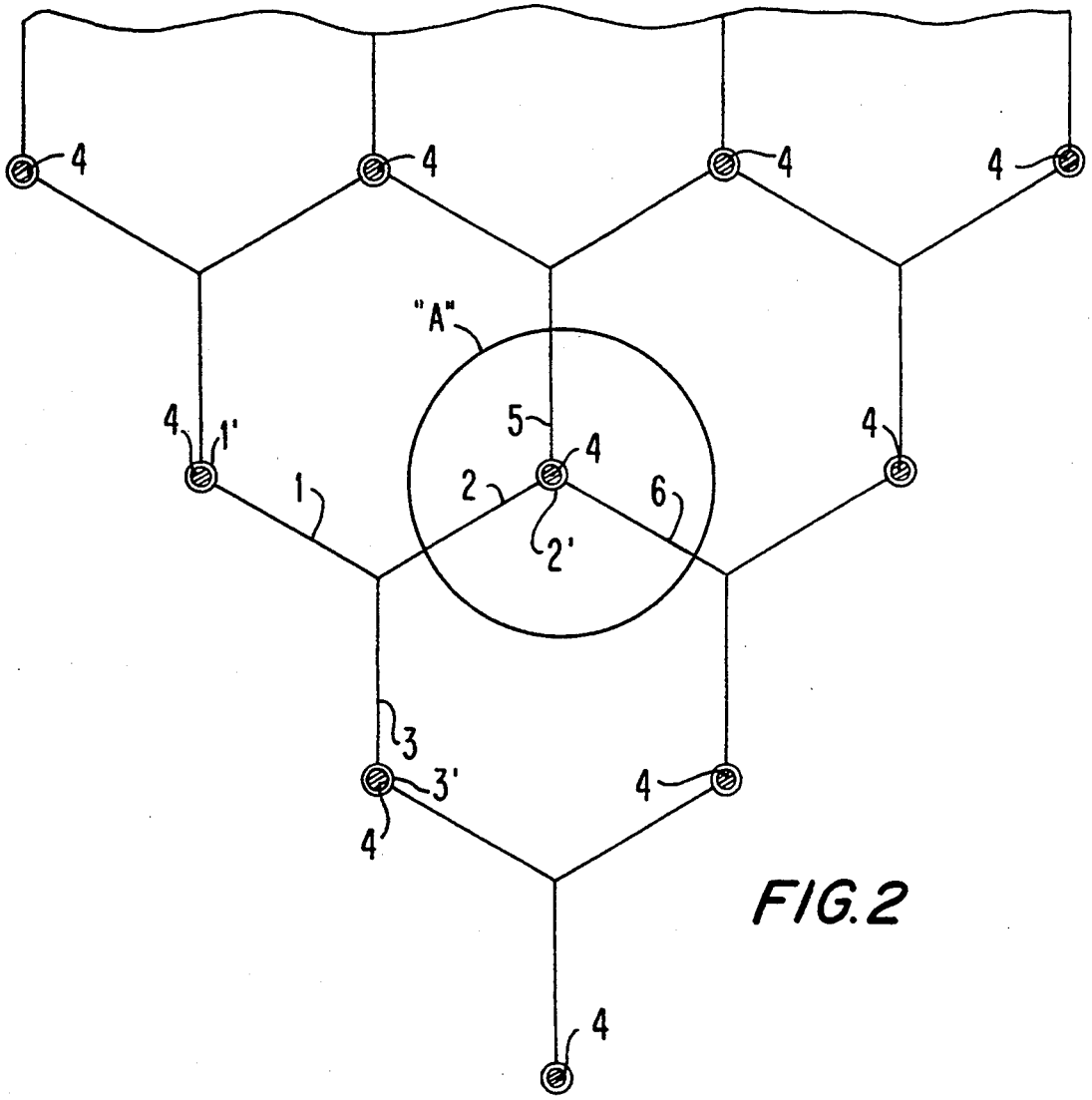
FIG. 2 is a cross-sectional view showing the honeycomb collecting electrodes consisting of the star-shaped elements.

FIG. 2 is a simplified schematic transverse sectional view showing the honeycomb collecting electrodes provided with the connecting rods 4. Adjacent star-shaped elements are connected by the connecting rods 4. Each connecting rod 4 extends in the tube sections of at least two adjacent star-shaped elements.

Figure 3:
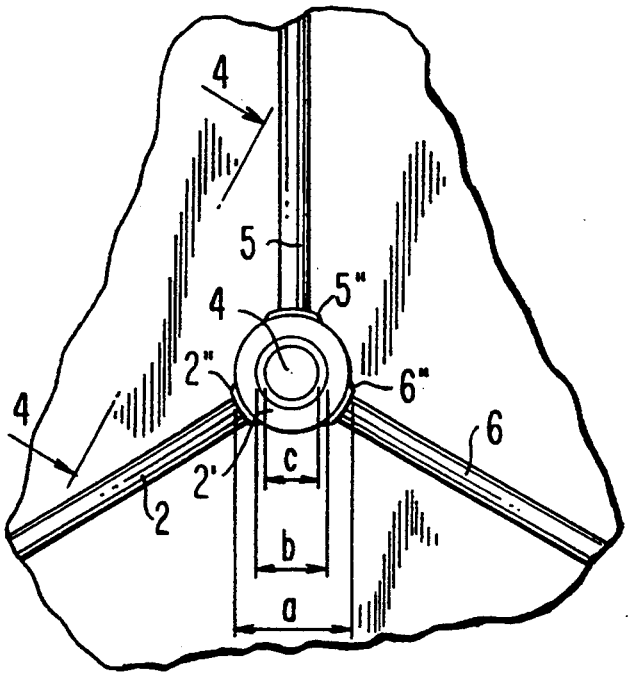
FIG. 3 is a top plan view showing a joint "A " in FIG. 3 between three star-shaped elements.

FIG. 3 is an enlarged view of the joint "A" in FIG. 2 between three starlike elements, which are connected by a connecting rod 4. The angle between two adjacent wall parts 2, 5, 6 is 120° . The outer edge of one wall part 2 is connected by a welded joint 2" to the tube section 2', in which the connecting rod 4 extends. The tube section 2' extends over the tube sections 5', 6', which are not shown in FIG. 3 and are joined by respective welded joints 5", 6" to the adjacent wall parts 5, 6. The tube section 2' has an outside diameter a of 10 to 40 mm and an inside diameter b of 5 to 35 mm. The diameter c of the connecting rod 4 amounts to 5 to 30 mm.

Figure 4:
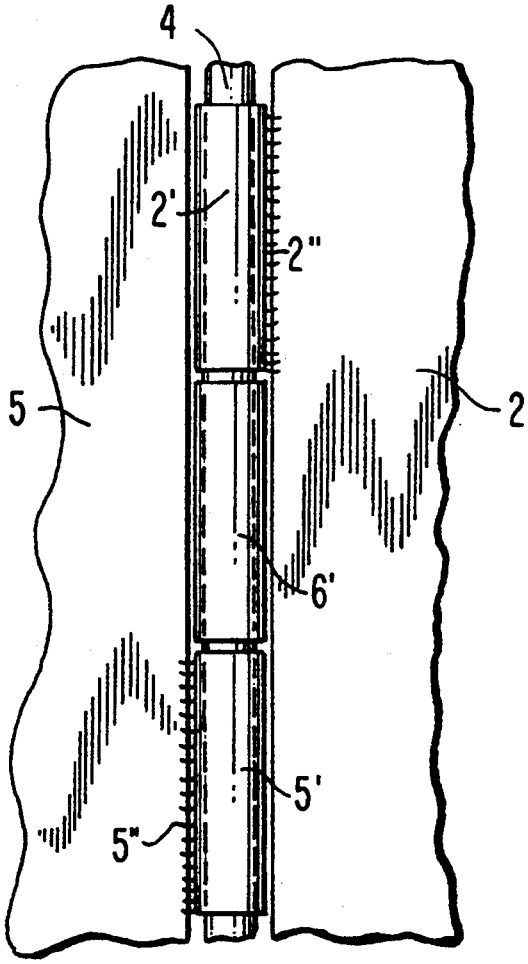
FIG. 4 is a side elevation showing a vertical sectional view taken on line B—B in FIG. 1 and showing a joint between three star-shaped elements.

FIG. 4 is a vertical sectional view taken on section line B—B in FIG. 3 and showing the joint. The two wall parts 2, 5 have been turned into the paper plane of the drawing. The tube sections 2', 5', 6' are arranged one over the other and are joined by respective welded joints 2", 5" to the adjacent outer edge.

But the device in accordance with the invention is not restricted to the embodiment shown in FIGS. 1 to 4.

We claim:

1. An electrostatic separator comprising honey-comb collecting electrodes, which consist of star-shaped elements, wherein each star-shaped element consists of three wall parts (1, 2, 3), which are centrally joined and extend at an angle of 120° to each other, at least one tube section (1', 2', 3', 5', 6') extends along the outer edge of each wall part, the tube sections (2', 5', 6') of any two adjacent star-shaped elements are arranged one over the other and adjacent star-shaped elements are connected by a connecting rod (4), which extends in the tube sections (1', 2', 3', 5', 6') of at least two adjacent star-shaped elements.

2. An electrostatic separator according to claim 1, wherein the star-shaped elements are made of an electrically conductive plastic.

* * * * *